United States Patent [19]

Creighton

[11] 4,030,644

[45] June 21, 1977

[54] NON-RETURN SAFETY VALVE ASSEMBLY AND PRESSURE PACK INCORPORATING SAME

[76] Inventor: John Joseph Creighton, 100 Park Road, East Hills, New South Wales, Australia, 2213

[22] Filed: May 21, 1976

[21] Appl. No.: 688,677

[30] Foreign Application Priority Data

Feb. 26, 1976 Australia ..... 11473/76

[52] U.S. Cl. ..... 222/396; 222/402.24

[51] Int. Cl.[2] ..... B65D 8/14

[58] Field of Search ..... 222/402.16, 400.7, 402.24, 222/396

[56] References Cited

UNITED STATES PATENTS

| | | | |
|---|---|---|---|
| 2,839,225 | 6/1958 | Soffer et al. | 222/402.16 |
| 3,375,957 | 4/1968 | Kuffer | 222/402.16 |

*Primary Examiner*—Robert B. Reeves
*Assistant Examiner*—Hadd Lane
*Attorney, Agent, or Firm*—Edward C. Threedy

[57] ABSTRACT

The valve assembly permits the filling and refilling and pressurization of a container which discharges a fluid under the influence of a propellant pressure within the container. It incorporates a relief valve to guard against over-filling or over-pressurization, facilities the attachment of a pressurization pump, a discharge hose, or a discharge nozzle, and a regulator for the magnitude of the discharge of the fluid from the container. The assembly screws into or onto a container and avoids the proliferation of discarded pressurized containers and material wastage.

10 Claims, 1 Drawing Figure

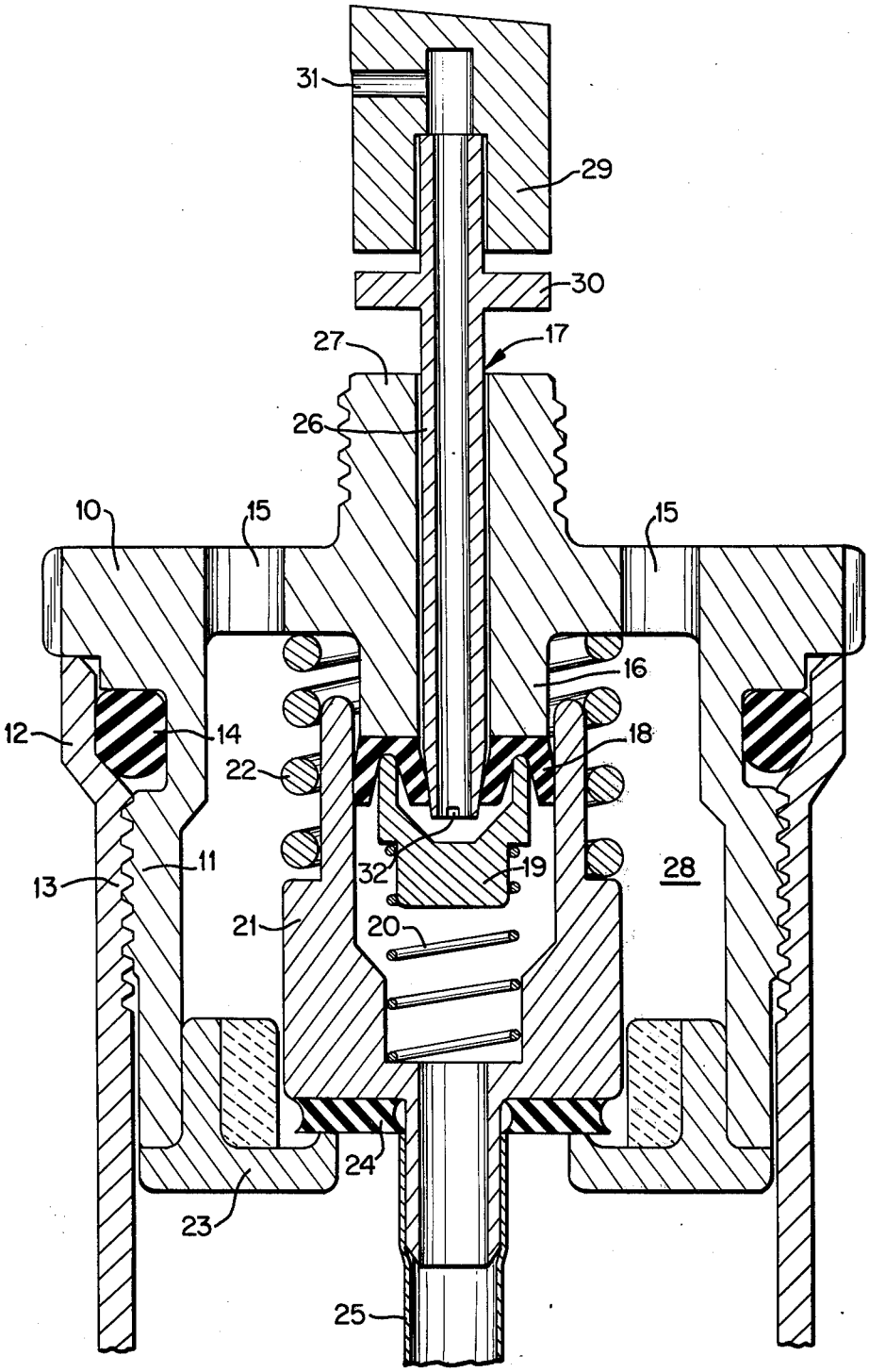
31
29
30
27
17
26
10
15
15
16
12
14
18
22
32
19
28
13
11
21
20
24
23
25

NON-RETURN SAFETY VALVE ASSEMBLY AND PRESSURE PACK INCORPORATING SAME

SUMMARY OF THE INVENTION

The present invention relates to a valve assembly to be associated with a container to be used in the dispensing of a fluid material under the influence of a propellant under pressure within the container. The assembly is used generally in what is commonly referred to as a "pressure pack" but it may also be used in a variety of other applications where a fluid is to be discharged from a container by force of internal pressure.

While the object of the present invention is to provide an inexpensive, simple yet reliable valve assembly which is efficient in operation a number of other advantages may be obtained.

One advantage of the valve assembly of the present invention is that when incorporated in a pressure pack, the filling, re-filling and pressurising of the container or pressure pack is a relatively simple and inexpensive matter. By the use of the valve assembly of the present invention, a pressure pack no longer needs to be discharged when empty and need no longer be thrown away to pollute the environment and waste valuable materials. The valve of this invention allows the container or pressure pack to be re-used, thereby effecting a considerable saving in materials, time and the ultimate cost of the pack. Furthermore when an air-pump is used to pressurize (and re-pressurize) the container by using this valve, the atmosphere is thereby saved from the discharge thereinto of polluting propellant gases such as freon and butane which hitherto are usually used in non-fillable aerosol containers or pressure packs. However other known means of pressurisation may be employed.

Another advantage provided by a modification is that the present invention provides a simple means of discharging fluid as an aerosol from the container or pressure pack through a hose connected to the container.

A further advantage provided by another modification is that some control may be provided over the rate of discharge of the contents of the container.

Yet a further advantage of the present invention is the protection provided by the safety mechanism of the valve which prevents the container from bursting due to excessive pressure being applied to the container during pressurisation, or an increase in temperature, and so the avoidance of risk of injury to the user.

Whilst other valves may possess one or more of the afore-mentioned advantages, none hitherto have possessed all these advantages, or have provided the facilities of the invention in such a compact, less expensive and versatile form.

Furthermore most of the parts of the valve assembly of this invention may be made from a synthetic plastic material and may be made to be quick press fit one to the other, thereby effecting savings in the time and labour of assembly and consequently the cost of the valve assembly.

Accordingly the invention provides a valve assembly for use in a container for dispensing fluids under the influence of pressure within the container comprising an outer valve casing having screw threads thereon to co-operate with screw threads on the container to couple the two together in conjunction with a sealing ring to provide an airtight but releasable connection, relief holes on the top of the casing to allow the escape of excess propellant pressure or liquid, a centrally and axially located up-standing neck on the outer valve casing, an internally extending locating flange on the under side of the outer valve casing, said locating flange being coaxial with the said axially located neck, a bore passing through the axially located neck and the internally extending locating flange, a cylindrical inner valve casing having an internal axial bore which is a sliding outer fit around the said internally extending locating flange, an annular valve insert supported below the said inner valve casing by the outer valve casing and said annular valve insert capable of bearing against the bottom of the said inner valve casing to form a gas and liquid-tight seal, an inverted-U cross-section ring gasket mounted coaxially on the lower face of the internally extending locating flange the outer edge of said ring gasket bearing against the periphery of the internal axial bore of the cylindrical inner valve casing to form a gas and liquid-tight seal between said inner valve casing and the said internally extending locating flange, a dip-tube extending the internal axial bore of the cylindrical inner valve casing down through the annular valve insert into the container, a valve stopper with an annular upstanding wall which seats in the inverted-U ring gasket, a spring inserted between the base of the axial bore of the inner valve casing and the valve stopper to urge the latter into contact with the inverted-U ring gasket to form a gas and liquid-tight seal, and an actuator discharge tube which passes down the bore through the neck of the outer valve casing sufficiently far to be able to bear upon the spring urged valve stopper and depress it to break the seal when the said actuator tube is pressed, said actuator discharge tube sliding through the inverted-U ring gasket to form a seal with the exterior surface of the actuator discharge tube and said actuator discharge tube having gaps in the periphery of its lower edge to allow the contents of the container to escape.

GENERAL DESCRIPTION

To further describe the invention by way of example only, one embodiment thereof will be described with reference to the accompanying drawing which shows a cross-section through a valve according to the invention, all sections of the valve being symmetrical. It will however be appreciated by those skilled in this art that no ingenuity would lie in providing thread on the outside of the container instead of the inside as shown in the drawing for the purpose of screwing the valve assembly and the container together.

Referring now to the drawing, a valve assembly according to the invention comprises a cylindrical outer valve casing 10 which is threaded at 11 to engage releasably with a cylindrical container 12 correspondingly threaded at 13. A sealing ring 14 is provided between the outer valve casing 10 and the wall of the container 12. The outer valve casing 10 is provided with a number of safety or relief holes 15 through which excess pressurisation or fluid contents in the container 12 may be discharged.

The outer valve casing 10 has an axially located neck 27 which optionally may be externally threaded and an internally extending locating flange 16. A bore 17 passes through the neck 27 and the flange 16, the bore 17 being sealed from the main bore or main chamber 28 of the outer valve casing 10 by a non-return valve comprising a cylindrical inner or non-return valve casing 21 which is a sliding fit around the locating flange 16 so that the bore of the non-return valve casing 21 is aligned with the bore 17. A rubber or plastic inverted-U cross-section ring gasket 18 engages against the locating flange 16 and the internal wall of the non-return valve casing 21, whilst a non-return valve stopper 19 seats in the U-gasket 18 and is releasably held there in a closed position by spring pressure from an inner spring 20, thereby providing seals which prevents contents from escaping from the container 12 up the bore 17 or into the main chamber 28 of the outer valve casing 10.

The non-return or inner valve casing 21 is held in position by means of an outer spring 22 and seats on a valve insert 23 with a washer 24 being provided therebetween.

In operation, when it is desired to fill and pressurize the container 12, fluid contents are poured therein the valve assembly is screwed into or onto the threaded top 13 of the container 12 (according to whether the thread is provided on the inner or outer surface of the container), and an air pump (not shown) is threaded releasably around the neck 27 of the outer valve casing 10. The container 12 is then pressurized to the required pressure merely by pumping in air from the pressure pump. Other pressurisation means may also be used. The safety or relief valve action of the valve assembly corrects any over-pressurisation because too much pressure forces the non-return valve casing 21 up against the springs 20 and 22 thereby overcoming pressure from these springs, the non-return casing 21 acting in this case as the disc of the safety or relief valve. Once the casing 21 is raised against the spring pressure the contents of the container 12 may escape to the atmosphere through the safety or relief holes 15.

The air pump or other pressurisation means is then removed and an actuator discharge tube 29 having a bore extending axially through its stem to a discharge nozzle 31, is inserted in the bore 17. The actuator discharge tube 29 itself may be threaded or may be provided with a threaded collar over an optional flange 30 located on the actuator discharge tube 29. This allows the non-return valve portion of the valve assembly to be held in an open position and also allows a measure of control over the rate of discharge of fluid by turning the threaded collar in a clockwise or anti-clockwise direction This arrangement also allows a tube or hose to be attached to the valve assembly and the fluid to be discharged therethrough rather than through the nozzle of the actuator discharge tube 29.

When it is desired to discharge the container contents the actuator discharge tube 29 is depressed, thereby overcoming the pressure of the inner spring 20 and forcing the non-return valve stopper 19 out of engagement with the U gasket 18 so allowing the contents of the container 12 to escape up the bore of a dip-tube 25 and through the chamber of the non-return or inner valve casing 21, around the U gasket 18 and up the bore of the actuator. This is possible because the lower end of the stem 26 of the actuator discharge tube 29 has gaps 32 in its periphery to allow the contents to escape. The contents are prevented from entering the bore 17 by the engagement of the actuator with the U gasket 18. The contents are then discharged through the discharged nozzle 31 of the actuator to the atmosphere. By utilising the base portion of the non-return valve, that is by utilising the casing of the inner or non-return valve as the moving part or disc of the safety/relief valve, use is made of a back pressure assisting the spring 22 to hold the safety or relief valve closed. Without this assistance, the spring 22 would have to be very much stronger and consequently that much more expensive. Using the non-return valve spring 20, either alone or in cooperation with the spring 22 to hold the safety valve closed, is a feature of the present invention.

The valve assembly of the present invention incorporates a three-way seal, sealing by the U gasket 18 and non-return stopper 19 to prevent escape of the contents up the bore of the dip-tube 25 into the bore 17, and into the chamber 28 of the main valve casing 10 (when the stem 26 of the actuator discharge tube 29 is inserted in the bore 17 it seals on the inner flange of the U gasket 18 before engaging the non-return stopper 19), and preventing escape of the contents from the container directly into the main chamber 28 of the valve assembly and so out the holes 15.

Having thus described my invention, what I claim as new and desire to protect by Letters Patent is:

1. A valve assembly for use in a container for dispensing fluids under the influence of pressure within the container comprising a. an outer valve casing having screw threads thereon to cooperate with screw threads on the container to couple the two together in conjunction with a sealing ring to provide an air-tight but releasable connection, b. relief holes on the top of the casing to allow the escape of excess propellant pressure or liquid, c. a centrally and axially located upstanding neck on the outer valve casing, d. an internally extending locating flange on the under side of the outer valve casing, and coaxial with said axially located neck, e. a bore passing through the axially located neck and the internally extending locating flange, f. a cylindrical inner valve casing having an internal axial bore which is a sliding outer fit around said locating flange, g. an annular valve insert supported below the inner valve casing by the outer valve casing and said annular valve insert capable of bearing against the bottom of said inner valve casing to form a gas and liquid-tight seal, h. an inverted-U cross-section ring gasket mounted coaxially on the lower face of the locating flange, the outer edge of said ring gasket bearing against the periphery of the internal axial bore of the cylindrical inner valve casing to form a gas and liquid-tight seal between said inner valve casing and the said internally extending locating flange, i. a dip-tube extending into the internal axial bore of the cylindrical inner valve casing down through the annular valve insert into the container, j. a valve stopper with an annular upstanding wall which seats in the inverted-U ring gasket, k. a spring inserted between the base of the axial bore of the inner valve casing and the valve stopper to urge the latter into contact with the inverted-U ring gasket to form a gas and liquid-tight seal, and l. an actuator discharge tube which passes down the bore through the neck of the outer valve casing sufficiently far to be able to bear upon the spring-urged valve stopper and depress it to break the seal when said actuator tube is pressed, said actuator discharge tube sliding through the inverted-U ring gasket to form a seal with the exterior surface of the actuator discharge tube and said actuator discharge tube having gaps in the periphery of its lower edge to allow the contents of the container to escape.

2. A valve assembly as defined in claim 1 wherein there is included a spring between the underside of the outer valve casing and the cylindrical inner valve casing to urge the latter against the annular valve insert.

3. A valve assembly as defined in claim 1, wherein the actuator discharge tube is provided with a discharge nozzle at the top thereof to direct the discharge in the desired direction.

4. A valve assembly as defined in claim 2, wherein the actuator discharge tube at the top thereof is provided with a discharge nozzle to direct the discharge in the desired direction.

5. A valve assembly as claimed in claim 1 in which an external screw thread is provided on the axially located up-standing neck on the outer valve casing.

6. A valve assembly as claimed in claim 2 in which an external screw thread is provided on the axially located upstanding neck on the outer valve casing.

7. A valve assembly as claimed in claim 3 in which an external screw thread is provided on the axially located upstanding neck on the outer valve casing.

8. A valve assembly as defined in claim 1 in which the actuator discharge tube is provided with a flange to cooperate with a threaded collar placed upon the actuator discharge tube.

9. A valve assembly as defined in claim 2 in which the actuator discharge tube is provided with a flange cooperating with a threaded collar placed upon the actuator discharge tube.

10. A valve assembly as defined in claim 3 in which the actuator discharge tube is provided with a flange cooperating with a threaded collar placed upon the actuator discharge tube.

* * * * *